US007969373B2

(12) United States Patent
Tsilioukas et al.

(10) Patent No.: US 7,969,373 B2
(45) Date of Patent: Jun. 28, 2011

(54) UHF/VHF PLANAR ANTENNA DEVICE, NOTABLY FOR PORTABLE ELECTRONIC EQUIPMENT

(75) Inventors: Efthimios Tsilioukas, Kassandria (GR); Peter Boekestein, Heeze (NL)

(73) Assignee: NXP B.V., Eindhoven (NL)

( * ) Notice: Subject to any disclaimer, the term of this patent is extended or adjusted under 35 U.S.C. 154(b) by 418 days.

(21) Appl. No.: 12/091,023

(22) PCT Filed: Oct. 18, 2006

(86) PCT No.: PCT/IB2006/053844

§ 371 (c)(1), (2), (4) Date: Jan. 12, 2009

(87) PCT Pub. No.: WO2007/049193

PCT Pub. Date: May 3, 2007

(65) Prior Publication Data

US 2009/0160720 A1 Jun. 25, 2009

(30) Foreign Application Priority Data

Oct. 26, 2005 (EP) ..... 05300865

(51) Int. Cl.
*H01Q 11/12* (2006.01)

(52) U.S. Cl. ..... 343/744; 343/741; 343/866

(58) Field of Classification Search ..... 343/702, 343/741, 742, 744, 866, 867
See application file for complete search history.

(56) References Cited

U.S. PATENT DOCUMENTS 2,551,664 A * 5/1951 Galper ..... 428/43
3,631,499 A * 12/1971 Turner ..... 343/701
3,641,576 A * 2/1972 Farbanish ..... 343/743
3,956,751 A * 5/1976 Herman ..... 343/744
4,518,965 A * 5/1985 Hidaka ..... 343/742
4,647,937 A * 3/1987 Hidaka et al. ..... 343/742
6,144,346 A 11/2000 Boy
7,750,866 B2 * 7/2010 Rambeau et al. ..... 343/866

FOREIGN PATENT DOCUMENTS

DE 9201543 U1 4/1992
EP 0957533 A1 11/1999
JP 58050830 A 3/1983
JP 2000077934 A 3/2000
WO 2005006579 A1 1/2005

* cited by examiner

*Primary Examiner* — Tho G Phan

(57) ABSTRACT

A planar antenna device (AD) for a TV receiver (R) comprises i) a loop antenna (LA) comprising first (E1) and second (E2) ends spaced one from the other, ii) a tuning means (TM) connected to the first (E1) and second (E2) ends of the loop antenna (LA) and arranged to control the frequency of the VHF TV signals this loop antenna (LA) is able to receive from command signals, iii) a first ground plane (GP1) cooperating with the loop antenna (LA) in order to act as a UHF monopole in receiving TV signals with UHF frequencies, iv) a first coupling means (CM1) coupled to the loop antenna (LA) at a first chosen location and arranged to deliver the received VHF signals, v) a second coupling means (CM2) coupled to the loop antenna (LA) at a second chosen location and arranged to deliver the received UHF signals, vi) an amplification means (AM) coupled to the first ground plane (GP1) and arranged to amplify TV signals, and vii) a switching means (SM) arranged to couple the amplification means (AM) to the first coupling means (CM1) and/or to the second coupling means (CM2) in dependence on command signals in order that the amplification means deliver amplified selected TV signals with VHF and/or UHF frequencies to an output.

15 Claims, 6 Drawing Sheets

UHF/VHF PLANAR ANTENNA DEVICE, NOTABLY FOR PORTABLE ELECTRONIC EQUIPMENT

FIELD OF THE INVENTION

The present invention relates to the domain of television (TV) antennas, and more precisely to small-size planar TV antennas which can be used in electronic equipment to feed a TV receiver with TV signals.

BACKGROUND OF THE INVENTION

Nowadays, more and more electronic devices are adapted to display television programs. This is notably the case of some portable equipment such as personal digital assistants (or PDAs), portable television and laptops. Because of the small size of these items, the size of their TV antennas needs to be reduced as much as possible.

This size reduction becomes an important issue when the frequency of the transmitted TV (RF) signals belongs to the VHF band, which is part of the new off-air standard for TV broadcasting DVB-T. It is noted that the DVB-T standard comprises part of the VHF band (from 170 MHz to 220 MHz), which corresponds to wavelengths approximately equal to 1.5 m, and the entire UHF band (from 470 MHz to 855 MHz), which corresponds to wavelengths between approximately 0.64 m and 0.35 m. If one assumes that the size of the TV antenna must be equal to a quarter wavelength in order to achieve a good TV signal reception, it follows from the above values that the TV antenna size must be of the order of 37 cm if the signal frequency belongs to the VHF band and between 16 cm and 6 cm if the signal frequency belongs to the UHF band. So, if it is possible, although difficult, to design a standard antenna providing an acceptable signal reception over the entire UHF band in a portable device, it is impossible to do so if the antenna also needs to receive TV signals with frequencies belonging to the VHF band, i.e. for frequencies in the UHF and VHF bands.

SUMMARY OF THE INVENTION

So, the object of this invention is to offer a new type of UHF/VHF planar antenna device capable of overcoming the above-mentioned drawback of the standard TV antennas, particularly of those used to feed TV receivers of portable equipment.

For this purpose, it provides a planar antenna device, for a piece of electronic equipment, comprising:

- a loop antenna having a chosen shape and comprising first and second ends spaced one from the other,
- a tuning means connected to the first and second ends of the loop antenna and arranged to control the frequency of the VHF TV signals that this loop antenna LA is able to receive from command signals,
- a first ground plane coupled so as to cooperate with the loop antenna in order that it acts as a UHF monopole for receiving UHF TV signals,
- a first coupling means coupled to the loop antenna at a first chosen location and arranged to deliver the received TV signals having VHF frequencies,
- a second coupling means coupled to the loop antenna at a second chosen location and arranged to deliver the received TV signals having UHF frequencies,
- an amplification means coupled to the first ground plane and arranged to amplify TV signals, and

- a switching means arranged to couple the amplification means to the first coupling means and/or to the second coupling means in dependence on command signals such that the amplification means delivers amplified selected TV signals with VHF and/or UHF frequencies to an output.

The planar antenna device according to the invention may have additional characteristics considered separately or combined, i.e.:

- in a first embodiment, the amplification means and switching means may be located outside the loop antenna. In this case, i) the switching means comprises first and second inputs connected to the first and second coupling means, respectively, and an output connected to an input of the amplification means and connectable either to the first input or to the second input, in dependence on command signals, ii) the first coupling means comprises a coupling loop having first and second ends connected to the first input of the switching means and to the first ground plane, respectively, and iii) the second coupling means is a coupling track defining a UHF monopole connecting the loop antenna to the second input of the switching means;
  - the loop antenna may have an approximately square shape;
  - the coupling loop may be of a single-ended type with a far end connected to the first ground plane, or of the differential type with a coupling to the amplification means via a balun;
  - the coupling loop may have an approximately rectangular shape;
- in a second embodiment, the amplification means and switching means may be located in a chosen part of an area which is defined by the loop antenna and which comprises a second ground plane defining ground for the amplification means and connected to the first ground plane through a direct wiring connection. In this case, i) the first coupling means comprises at least one coupling track connected to the loop antenna at the first chosen location and coupled to the amplification means, and ii) the second coupling means is connected to the loop antenna at the second chosen location and to the switching means;
  - the amplification means may comprise a first amplifier coupled to the first coupling means and to the second ground plane for amplifying the selected received TV signals having the VHF frequencies and a second amplifier coupled to the loop antenna through the second coupling means and to the second ground plane for amplifying the selected received TV signals having the UHF frequencies;
  - the amplification means may comprise a common amplifier coupled to the first coupling means, to the loop antenna through the second coupling means, and to the second ground plane for amplifying the selected received TV signals having the VHF frequencies and/or the UHF frequencies;
  - the loop antenna may have an approximately rectangular shape;
- the tuning means may comprise two identical varactors (or varicaps) mounted in series and having first terminals connected to the first and second ends of the loop antenna, respectively, and second terminals DC grounded through first and second decoupling inductance means;
- it may comprise a digital to analog converter (or DAC) arranged to convert some received digital command signals into analog command signals and/or at least one command line to provide some other command signals;

at least the loop antenna, tuning means, first coupling means, amplification means, switching means, DAC and command line may be defined on a printed circuit board.

The invention also provides an electronic device comprising a planar antenna device such as the one described above and a TV receiver connected to the antenna.

Such an electronic device may be a mobile (or cellular) phone, a personal digital assistant (or PDA), a portable television, or a laptop, for instance.

BRIEF DESCRIPTION OF THE DRAWINGS

Other features and advantages of the invention will become apparent from a perusal of the detailed specifications given below with reference to the appended drawings, wherein.

The appended drawings may serve not only to complete the invention, but also to contribute to its definition, if need be.

DESCRIPTION OF THE PREFERRED EMBODIMENTS

As was noted above, the invention offers a new type of UHF/VHF planar antenna device which can be used to feed e.g. a TV receiver of a portable device.

In the following description it will be considered that the TV receiver (NIM) is an integrated circuit which is part of a portable device (PE), such as a personal digital assistant (PDA), but the invention is not limited to this application. Indeed, the antenna may be used in any electronic equipment capable of displaying TV programs and requiring a planar antenna device, especially in a mobile (or cellular) phone, a cordless phone, a portable television, a personal computer, or a laptop.

Figure 1:
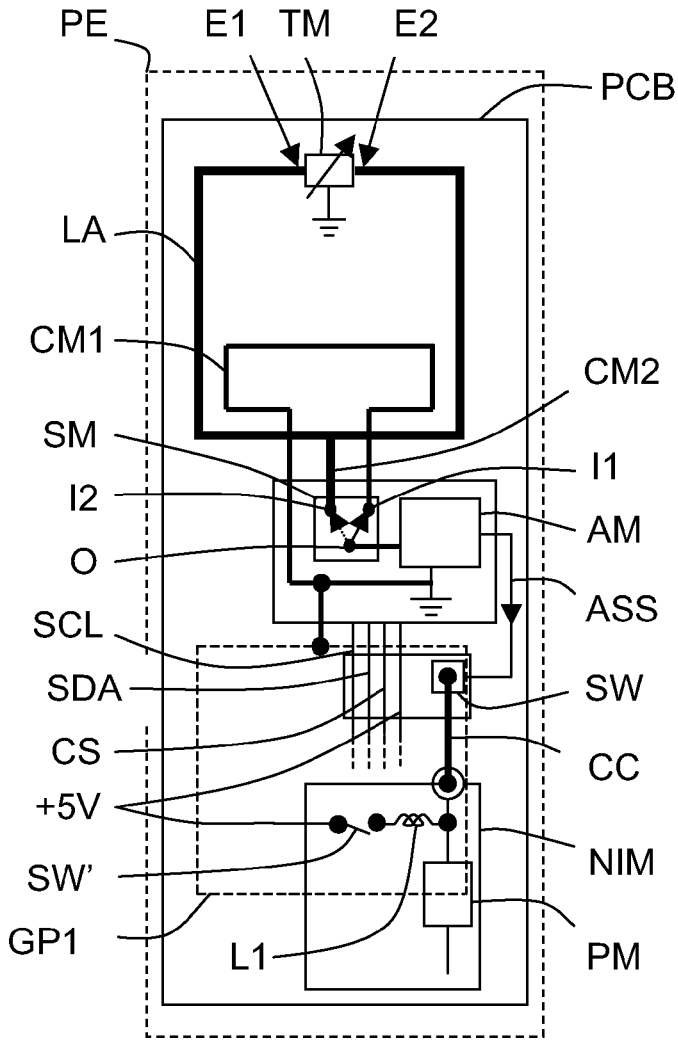
FIG. 1 schematically illustrates a portable device provided with a first embodiment of a planar antenna device according to the invention, FIG. 2 schematically illustrates an embodiment of a tuning module of a planar antenna device according to the invention, FIG. 3 schematically illustrates a portable device provided with a second embodiment of a planar antenna device according to the invention, FIG. 4 schematically illustrates a first embodiment of a main module of a planar antenna device according to the invention, FIG. 5 schematically details embodiments of the functional blocks of the main module illustrated in FIG. 4, FIG. 6 schematically illustrates a second embodiment of a main module of a planar antenna device according to the invention, and FIG. 7 schematically details embodiments of the functional blocks of the main module illustrated in FIG. 6.
Figure 3:
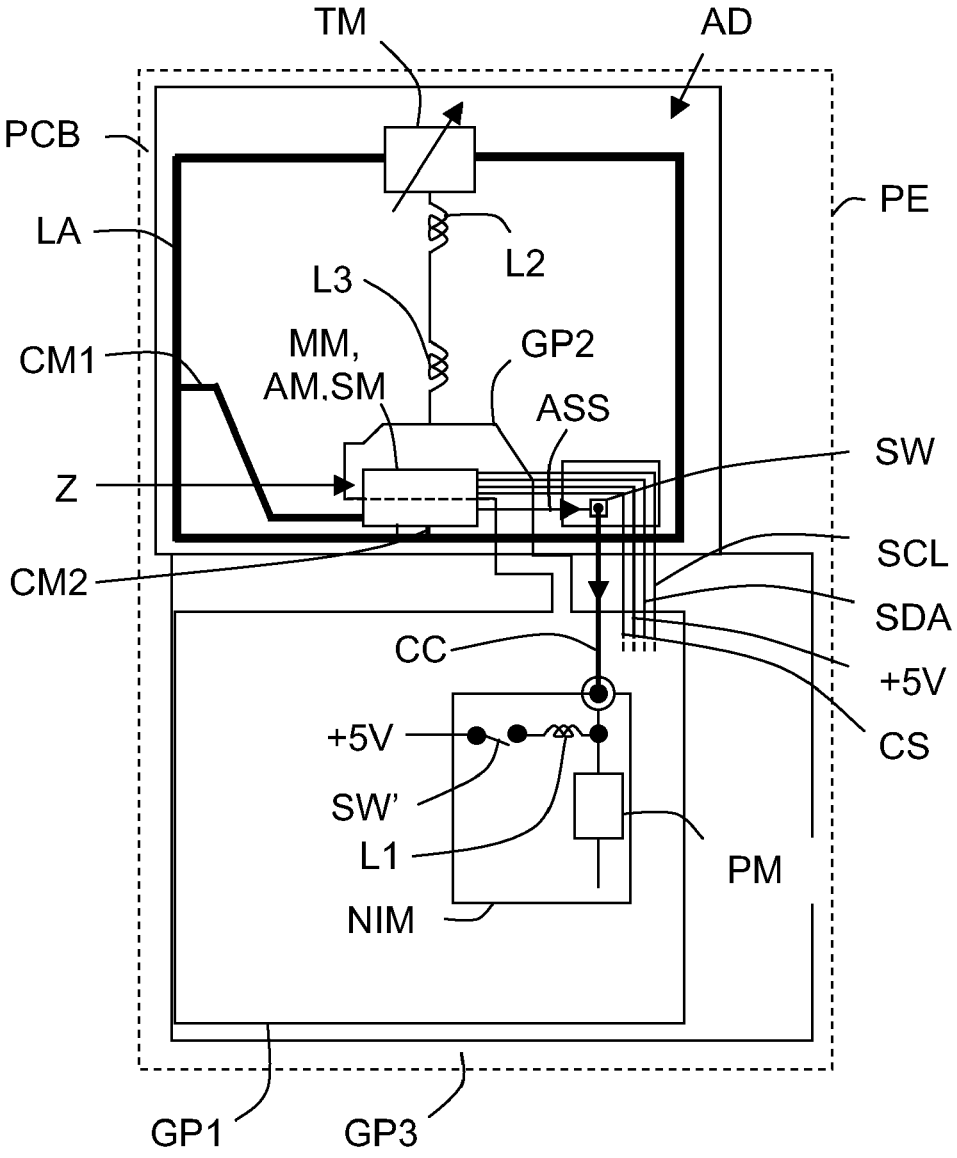
Figure 4:
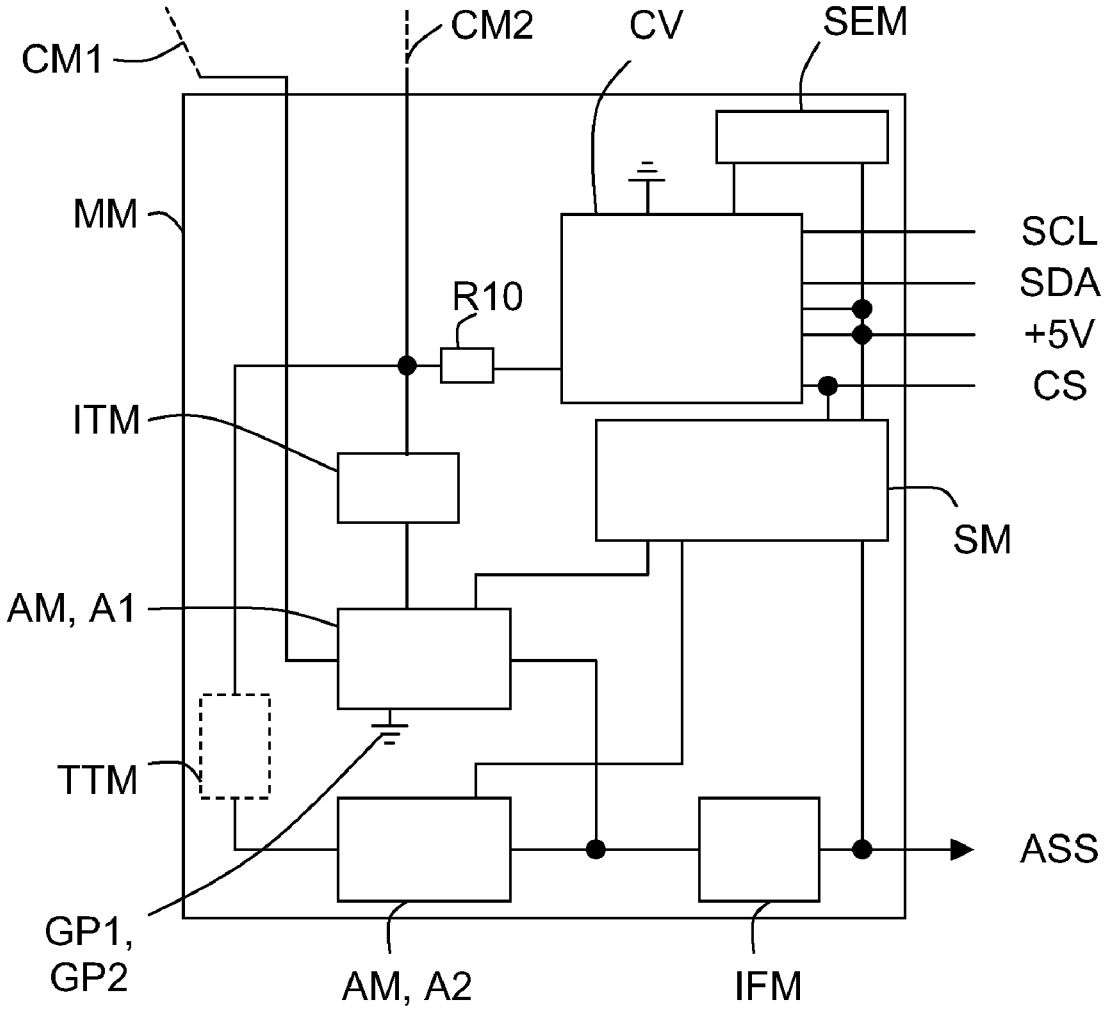

As illustrated in FIGS. 1 and 3, a planar antenna device AD according to the invention comprises at least:

a printed loop antenna LA having an approximately square shape (FIG. 1) or a rectangular shape (FIG. 3), or else a circular shape, for example, and comprising first E1 and second E2 ends spaced one from the other, a tuning module TM connected to the first E1 and second E2 ends. This tuning module TM is arranged to control the frequency of the VHF TV signals that the loop antenna LA is able to receive, when it receives command signals. The DVB-T standard covers part of the VHF band (from 170 MHz to 220 MHz, tuned by varicaps/varactors), a first ground plane GP1 having an approximately rectangular shape and cooperating with the loop antenna LA in order to receive UHF TV signals. The DVB-T standard also covers the entire UHF band (from 470 MHz to 855 MHz). For a proper UHF signal reception, the first E1 and second E2 open ends of the loop antenna LA must be kept away from this first ground plane GP1. In the case of UHF signals, the loop antenna LA acts as a monopole antenna, a first coupling means CM1 coupled to the loop antenna LA at a first chosen location and arranged to deliver the received TV signals having VHF frequencies at a first output, a second coupling means CM2 coupled to the loop antenna LA at a second chosen location and arranged to deliver the received TV signals having UHF frequencies at a second output, an amplification module AM (or A, or else A1 and A2) which is preferably of the low-noise type. This amplification module AM is grounded by means of the first ground plane GP1 and arranged to amplify TV signals, and a switching module SM arranged to couple the amplification module AM to the first output of the first coupling means CM1 and/or to the second output of the second coupling means CM2 in dependence on the command signal it receives such that the amplification module AM delivers amplified selected TV signals ASS having VHF and/or UHF frequencies to an output.

In this planar antenna device AD, the amplification module AM and the switching module SM may be located either outside the loop antenna LA (as illustrated in FIG. 1) or inside the area defined by the loop antenna LA (as illustrated in FIG. 3).

Moreover, the planar antenna device AD is preferably defined on a thin printed circuit board PCB. More precisely, at least the printed loop antenna LA, the tuning module TM, the switching module SM, and the amplification module AM (or A, or else A1 and A2) are defined on a first (component) side of the printed circuit board PCB, while the first ground plane GP1, the first coupling means CM1, and the second coupling means CM2 are defined on a second (component-free) side of the printed circuit board PCB, opposite to its first side.

The first ground plane GP1 may be the metal frame of the portable device PE or a copper foil insulated from the metal frame (which then defines a (third) ground plane GP3 as illustrated in FIG. 3), for example. Therefore the dimensions of the first ground plane GP1 are limited by the dimensions of the frame.

Figure 2:
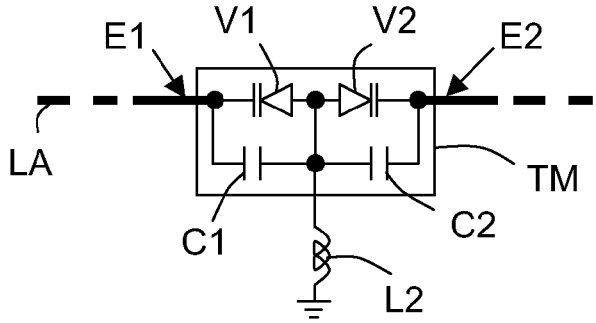

Reference is initially made to FIGS. 1 and 2 to describe a first embodiment of a planar antenna device AD according to the invention. As was noted above and as illustrated in FIG. 1, the amplification module AM and the switching module SM are located outside the loop antenna LA in this first embodiment.

For example, the dimensions of the loop frame LA defined on the first (component) side of the printed circuit board PCB are 60 mm by 60 mm.

As is schematically illustrated in FIG. 2, the tuning module TM may comprise two identical varactors (or varicaps) V1 and V2 mounted in series and having their first terminals (cathodes) connected to the first E1 and second E2 ends, respectively, of the loop antenna LA and their second terminals (anodes) DC grounded. The first terminals (cathodes) of varactors (or varicaps) V1 and V2 are fed with command signals (0 to 5 V) via the second coupling means CM2 for tuning (or alignment) purposes.

As is schematically illustrated in FIG. 2, the second terminals (anodes) of the varactors (or varicaps) V1 and V2 are preferably DC grounded through a vertical track, which has an inductance L2. In this first example, the vertical track may be wide (typically 3.5 mm) to enforce loop balance. This, however, is unnecessary if the lowest central point of the loop antenna LA is grounded. In the example of FIG. 1, the lowest central point of the loop antenna LA is open for VHF.

The tuning module TM may also comprise two identical capacitors C1 and C2, the first one C1 being mounted in parallel between the first and second terminals of varactor V1 and the second one C2 being mounted in parallel between the first and second terminals of varactor V2. These capacitors C1 and C2 are not mandatory. They are used when the varicaps or varactors V1 and V2 do not have the correct capacitance ratio for tuning between 170 MHz and 220 MHz.

In this first example, the first coupling means CM1, dedicated to the VHF signals, preferably comprises a small coupling loop (with a rectangular shape). In FIG. 1 the coupling loop CM1 is magnetically coupled to the loop antenna LA at the level of a first location and is single-ended (which means that its far end is connected to the first ground plane GP1). However, if the coupling loop CM1 has a floating differential structure a balun is required for interfacing it with the amplification module AM. This serves to make the coupling loop "invisible" for the UHF (antenna) signals. It is noted that a balun is usually implemented as a small transformer that achieves a balanced to unbalanced transformation.

In this example, the small coupling loop CM1 (which is single-ended) has first and second ends defining first and second subparts of the first output of the first coupling module CM1. These first and second subparts of the first output are connected to the first input I1 of the switching module SM and to the first ground plane GP1, respectively.

The second coupling means CM2 is preferably a coupling track defining a UHF monopole which is connected to the loop antenna LA at a second chosen location (preferably in the center of the side opposite to the side where the first E1 and second E2 ends are defined) and to the second input I2 of the switching module SM (through a via).

The switching module SM is part of a main module MM which is defined on the printed circuit board PCB. In addition to its first I1 and second I2 inputs, connected to the first and second outputs of the first CM1 and second CM2 coupling means, respectively, the switching module SM comprises an output O which can be coupled either to the first input I1 or to the second input I2, depending on the received command signal. So the output O delivers either selected TV signals with the VHF frequencies (provided by the loop antenna LA through the first coupling means CM1) when it is connected to its first input I1, or selected TV signals with the UHF frequencies (provided by the loop antenna LA (acting as a UHF monopole) through the second coupling means CM2) when it is connected to its second input I2.

The amplification module AM is also part of the main module MM. It comprises i) an input connected to the switching module output O and designed to be fed with the TV signals selected by the switching module SM, ii) at least one input connected to the first ground plane GP1, iii) several command inputs connected to micro lines (or control buses) and designed to be fed with command signals (SCL and SDA, and CS (command signal for the switching module SM)) and a supply input +5V (providing a voltage equal to +5 volts), and iv) an output to deliver amplified selected signals ASS.

The amplification module output is preferably connected, through an RF connector switching means SW and a via, to a micro coaxial cable CC, which in its turn is connected to a TV tuner receiver, also denoted NIM (Network Interface Module), to feed it with the amplified selected signals ASS.

The RF connector switching means SW is used to perform an external antenna function. More precisely, it may be connected to an RF connector of an external antenna cable connected to a passive external antenna.

The micro coaxial cable CC and the micro lines are preferably soldered to vias defined in the printed circuit board PCB. The shield of the micro coaxial cable CC is preferably soldered on a stop-lacquer free area near the amplification module output vias. So the micro coaxial cable CC is preferably soldered on the second, component-free side of the printed circuit board PCB while the micro lines can be routed on the first, component side of the printed circuit board PCB and soldered on the second, component-free side.

As illustrated, for example, the NIM (or receiver) comprises a TV signal processing module PM (tuner, intermediate frequency amplifier, channel decoder) connected to its TV signal input through a track to be fed with the selected amplified signals ASS. This track may be connected to a +5 V supply input through an inductance L1 and a switch SW' such that the portable device can switch its TV signal input to two states: either 0 V or +5 V (if the use of the external antenna function is selected, a passive external antenna inductance L1 must be switched to ground (0 V) by means of the RF connector switching means SW, and if the active external antenna is used, inductance L1 must be switched to 5V by means of the switch SW'). So, four cases are possible:

- there is no additional external antenna connected to the portable device and the 0V activates the planar antenna device AD,
- there is no additional external antenna connected to the portable device and the +5 V deactivates the planar antenna device AD,
- an additional external antenna (either passive or having its own supply) is connected to the portable device and the 0 V deactivates the planar antenna device AD (the RF output ASS is opened by the RF connector switching means SW),
- an additional external antenna is connected to the portable device and the RF connector switching means SW deactivates the planar antenna device AD and can power the external antenna (no need for a supply of its own).

In a modification, the switch SW' is omitted and the second terminal of the impedance L1 is connected to ground (GP1). The NIM thus has a low DC impedance (and 0V) at its TV signal input, so that the amplification module AM of the planar antenna device AD is activated when no external connector is plugged in. When an additional external antenna is plugged in (by means of the RF connector switching means SW), the planar antenna device AD is disabled in any case (independently of the DC impedance or potential of the additional external antenna).

Reference is now made to FIGS. 3 to 7 for a description of a second embodiment of a planar antenna device AD according to the invention. As mentioned above and as illustrated in FIG. 3, the amplification module AM and the switching module SM are located inside an area defined by the loop antenna LA in this second embodiment. More precisely, the amplification module AM and the switching module SM, which together form a main module MM, are located inside a chosen part Z of this area. A small second ground plane GP2 is preferably defined in the chosen part Z, on the first (component) side of the printed circuit board PCB. This second ground plane GP2 is connected to the first ground plane GP1 through a direct wiring (shortcut) connection.

The dimensions of the loop frame LA defined on the first (component) side of the printed circuit board PCB are, for example, 71 mm by 60 mm.

In this second example, the tuning module TM is identical to the one described above with reference to FIG. 2. But with the new configuration the vertical track has to be hidden. So, as is schematically illustrated in FIG. 3, the second terminals ("anodes") of the varactors V1 and V2 are now DC grounded for RF (170-220 MHz) through first L2 and second L3 decoupling inductances.

Because of the new dimensions, it is impossible to hide efficiently a first coupling means in the form of the small coupling loop of the first example (FIG. 1) for the VHF part in this second example. So, the first coupling means CM1 comprises a coupling track (or tap) connected to the main module MM and to the loop antenna LA at the first chosen location (on one of the sides which are perpendicular to the side where the first E1 and second E2 ends are defined).

The second coupling means CM2 is connected to the loop antenna LA at the second chosen location and to the switch module SM in this second example.

As was noted above, the second ground plane GP2, which grounds the amplification module AM, is connected to the first ground plane GP1 through a short direct wiring (short-cut) connection which may be flexible.

The main module MM, which will be described in detail below, comprises i) a first input connected to the first coupling means CM1, ii) a second input connected to the loop antenna LA through the second coupling means CM2, iii) a third input connected to the second ground plane GP2 (and therefore to the first ground plane GP1 through the direct wiring connection), iv) several command inputs connected to micro lines to be fed with command signals, such as SCL, SDA, CS, and a supply input +5 V (providing a voltage equal to +5 volts), and v) a signal output for delivering the amplified selected signals ASS.

As in the first example, the main module output is preferably connected, through an RF connector switching means SW (for connection to a passive external antenna) and a via, to a micro coaxial cable CC, which in its turn is connected to a NIM, to feed it with amplified selected signals ASS.

Moreover, as in the first example, the micro coaxial cable CC and the micro lines are preferably soldered to vias defined in the printed circuit board PCB. The shield of the micro coaxial cable CC is also preferably soldered on a stop-lacquer free area near the amplification module output vias. So the micro coaxial cable CC is preferably soldered on the second (component-free) side of the printed circuit board PCB while the micro lines can be routed on the first (component) side of the printed circuit board PCB and soldered on the second (component-free) side.

Moreover, the NIM is similar or identical to the one described above with reference to FIG. 1.

At least two embodiments may be envisaged for the main module MM. The first one will now be described with reference to FIGS. 3 to 5. The second one will be described later on with reference to FIGS. 3, 6, and 7.

In its first embodiment, the main module MM comprises an amplification module AM comprising first A1 and second A2 amplifiers, preferably of the low-noise type and dedicated to the VHF and UHF signal amplification, respectively.

More precisely, the first amplifier A1 is coupled to the (first) output of the first coupling means CM1 to amplify the TV signals with the VHF frequencies (when the second coupling means CM2 is RF grounded). The second amplifier A2 is coupled to the loop antenna LA through the second coupling means CM2 and to the second ground plane GP2 (and then to the first ground plane GP1 through the direct wiring connection) to amplify the TV signals with the UHF frequencies. When the second amplifier A2 is used, the loop antenna LA operates as a kind of monopole antenna and is single-ended to this second amplifier A2. This kind of antenna needs ground to operate properly (in this case this ground is the second ground plane GP2, the ground of the first amplifier A1) and is thus connected to the first ground plane GP1.

The first A1 and second A2 amplifiers comprise an output which is connected to an interface module IFM whose output delivers the amplified selected signals ASS that feed the micro coaxial cable CC.

Figure 5:
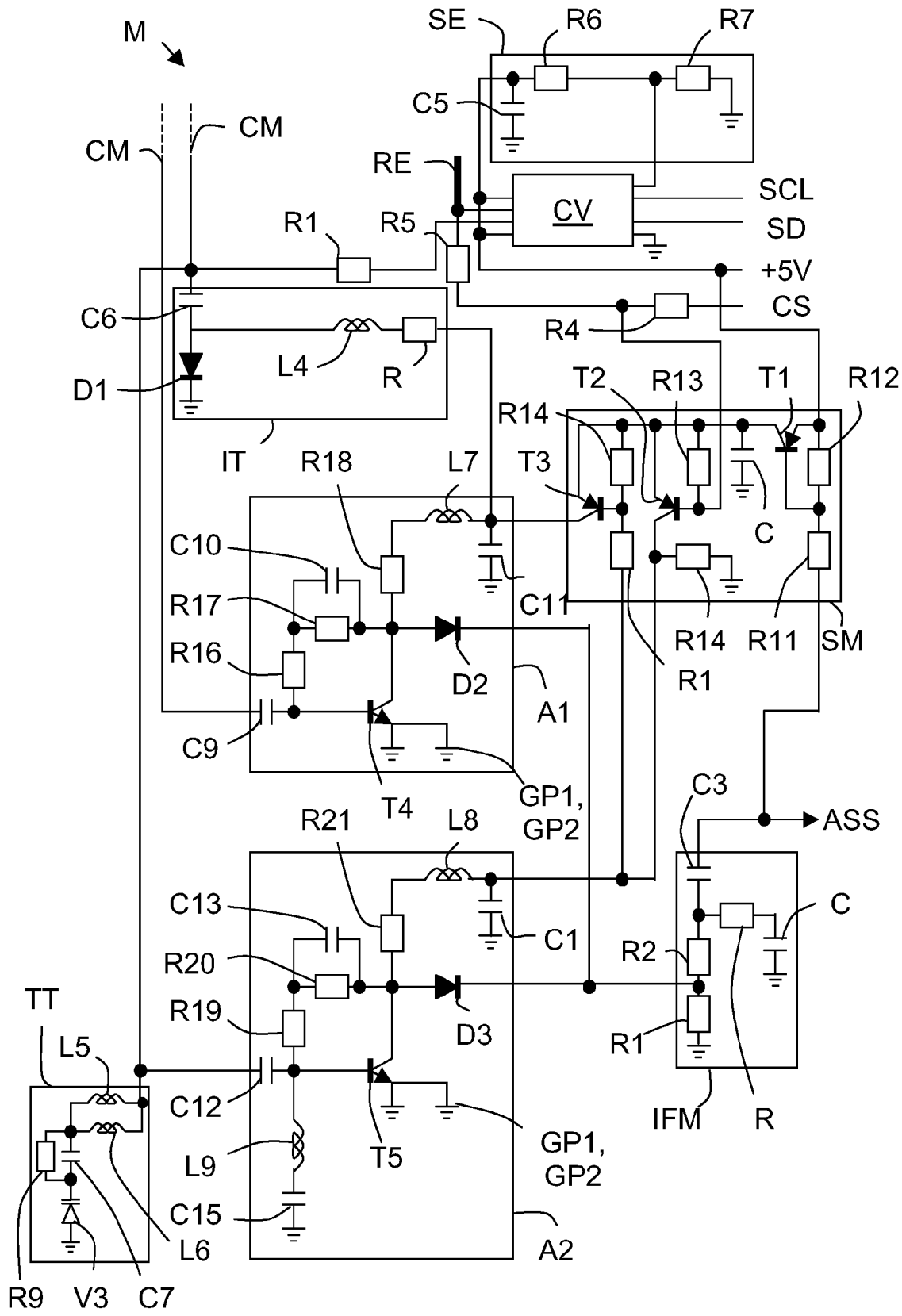

As is illustrated in FIG. 5, for example, the interface module IFM may comprise i) a first resistor R1 connected to ground (GP2) and to a first node (connected to the amplifier outputs), ii) a second resistor R2 connected to the first node and to a second node, iii) a first capacitor C3 connected to the second node and to an output delivering the amplified selected signals ASS, iv) a third resistor R3 comprising a first terminal connected to the second node and a second terminal, and v) a second capacitor C4 connected to the second terminal of the third resistor R3 and to ground (GP2).

The main module MM also comprises a digital to analog converter CV whose digital inputs are coupled to the micro lines SCL and SDA and whose analog inputs are coupled to ground (GP2), +5V, and to CS through resistors R4 and R5 mounted in series.

The two analog inputs of the converter CV, which are coupled to +5 V, are also coupled to a selection module SEM dedicated to address selection for programming through the ($I^2C$) bus control. This selection module SEM comprises, for example, a first resistor R6 connected to a first node and to a second node, the latter being connected to the analog inputs coupled to +5V and to a capacitor C5 which is also connected to ground (GP2), and a second resistor R7 connected to the first node and to ground (GP2). The first node is also connected to an analog input of the converter CV. Resistors R6 and R7 serve to determine the voltage on a pin of the converter CV, which is an address select pin. If the address select pin is left floating, the internal biasing will automatically set the address to a chosen address ("C2" (which is not the capacitor having the reference C2)).

The first amplifier A1 is also coupled to an intermediate module ITM. As illustrated in FIG. 5, the intermediate module ITM may comprise, for example, i) a capacitor C6 comprising a first terminal connected to the second coupling means CM2 and a second terminal connected to a first node (capacitor C6 is a DC blocking capacitor for the tuning voltage of varactors V1 and V2), ii) a diode D1 connected to the first node and to ground (GP2) (diode D1 is a switching diode to ground the second coupling means CM2 in VHF operation), iii) an inductance L4 comprising a first terminal connected to the first node and a second terminal, and iv) a resistor R8 comprising a first terminal connected to the second terminal of the inductance L4 and a second terminal (resistor R8 via inductance L4 defines a DC line).

A tunable trap module TTM may be connected to the input of the second amplifier A2 which is coupled to the central point of the loop antenna LA through the second coupling means CM2. This tunable trap module TTM is provided to filter the signal in the upper UHF range (for example an unwanted GSM signal) when it receives a dedicated command signal (VOUTB). As illustrated in FIG. 5, the tunable trap module TTM may comprise, for example: i) two inductors L5 and L6 mounted in parallel between a first node connected to the second coupling means CM2 and a second node, ii) a resistor R9 and a capacitor C7 mounted in parallel between the second node and a third node, and iii) a varicap diode V3 connected to the third node and to ground (GP2). The first node is coupled, through a resistor R10, to an analog output of the converter CV which delivers the dedicated command signal (VOUTB), which is the tuning voltage for the varicap diode V3.

As illustrated in FIG. 5, the switching module SM may comprise, for example:

- a first resistor R11 comprising a first terminal connected to the output of the interface module IFM and a second terminal connected to a first node,
- a second resistor R12 comprising a first terminal connected to the first node and a second terminal connected to a second node,
- a first transistor T1 comprising a base connected to the first node, an emitter connected to the second node, and a collector connected to a third node,
- a capacitor C8 connected to the third node and to ground (GP2),
- a third resistor R13 comprising a first terminal connected to the third node and a second terminal connected to a fourth node,
- a second transistor T2 comprising a base connected to the fourth node, an emitter connected to the third node, and a collector connected to a fifth node,
- a third resistor R14 comprising a first terminal connected to the fifth node and a second terminal connected to ground (GP2),
- a fourth resistor R14 comprising a first terminal connected to the third node and a second terminal connected to a sixth node,
- a fifth resistor R15 comprising a first terminal connected to the sixth node and a second terminal connected to the second amplifier A2, and
- a third transistor T3 comprising a base connected to the sixth node, an emitter connected to the third node, and a collector connected to the first amplifier.

As illustrated in FIG. 5, the first amplifier A1 may comprise, for example:

- a first capacitor C9 connected to the (first) output of the first coupling means CM1 and to a first node,
- a transistor T4 comprising a base connected to the first node, an emitter connected to ground (GP2 and then GP1), and a collector connected to a second node,
- a first resistor R16 comprising a first terminal connected to the first node and a second terminal connected to a third node,
- a second resistor R17 comprising a first terminal connected to the third node and a second terminal connected to the second node,
- a second capacitor C10 mounted in parallel between the second and third nodes,
- a diode D2 comprising a first terminal connected to the second node and a second terminal defining the first amplifier output which is connected to the signal input of the interface module IFM,
- a third resistor R18 comprising a first terminal connected to the second node and a second terminal,
- an inductance L7 comprising a first terminal connected to the second terminal of the third resistor R18 and a second terminal connected to a fourth node to which is connected the switching module SM and the second terminal of the resistance R8 of the intermediate module ITM, and
- a third capacitor C11 connected to the fourth node and to ground (GP2).

The first amplifier A1 may also comprise a low pass filter at the input of transistor T4 (i.e. connected to its first node) to cut off signals above 250 MHz.

The second amplifier A2 preferably has the same configuration as the first amplifier A1. So, as illustrated in FIG. 5, the second amplifier A2 may comprise:

- a first capacitor C12 coupled to the central point of the loop antenna LA through the second coupling means CM2 and to a first node,
- a transistor T5 comprising a base connected to the first node, an emitter connected to ground (GP2 and then GP1), and a collector connected to a second node,
- a first resistor R19 comprising a first terminal connected to the first node and a second terminal connected to a third node,
- a second resistor R20 comprising a first terminal connected to the third node and a second terminal connected to the second node,
- a second capacitor C13 mounted in parallel between the second and third nodes,
- a diode D3 comprising a first terminal connected to the second node and a second terminal defining the second amplifier output which is connected to the signal input of the interface module IFM,
- a third resistor R21 comprising a first terminal connected to the second node and a second terminal,
- an inductance L8 comprising a first terminal connected to the second terminal of the third resistor R21 and a second terminal connected to a fourth node to which is connected the switching module SM, and
- a third capacitor C14 connected to the fourth node and to ground (GP2).

The second amplifier A2 may also comprise an inductance L9 comprising a first terminal connected to its first node and a second terminal connected to a DC blocking capacitor C15 connected to ground and acting as a shortcut for UHF. The inductance L9 and the first capacitor C12 define a high pass filter. Capacitor C12 and inductance L9 can be chosen to cut off the signals below 400 MHz.

The planar antenna device AD offers three working modes with the configuration described above.

In a first working mode, the planar antenna device AD delivers both UHF and VHF signals.

In this case, the connector at the end of the micro coaxial cable CC must see a DC termination in the NIM. This is the case when the NIM is connected to the planar antenna device AD (inductance L1 connected to ground (GP2) at its input). This causes the first transistor T1 of the switching module SM to power the third T3 and fourth T4 transistors of the switching module SM, which are the switches to the first A1 and second A2 amplifiers, respectively. So, the first amplifier A1 can amplify the VHF signals received by the loop antenna LA and feed the interface module IFM with amplified VHF signals ASS, the second amplifier A2 can amplify the UHF signals received by the loop antenna LA and feed the interface module IFM with amplified UHF signals ASS.

When a connector of an additional external antenna is plugged in, the first resistor R11 of the switching module SM is floating. This turns the first transistor T1 of the switching module SM off, and the first A1 and second A2 amplifiers are both switched off. The external signal, provided by the additional external antenna, is then directly connected to the NIM.

If the additional external antenna requires a supply voltage, this may be switched on and off on the portable equipment side, either by the user (via an item on a menu) or by an autonomous switching circuit. If the user activates the +5V supply while no additional external antenna is plugged in, then the planar antenna device AD is switched off.

In a second working mode, the planar antenna device AD only delivers VHF signals.

In this case the command signal CS must be set high (for example >+4 V). Then the second transistor T2 of the switching module SM is off while the third transistor T3 of the switching module SM is on. So, the transistor T4 of the first amplifier A1 is powered on and the diode D1 of the intermediate module ITM is conductive, which RF-grounds the central point of the loop antenna LA through the second coupling means CM2 and the capacitor C6 of the intermediate module ITM. The transistor T4 of the first amplifier A1 is fed with the tapped VHF signals delivered by the first coupling means CM1 through the first capacitor C9 of the first amplifier A1. The diode D2 of the first amplifier A1 being also switched on, it delivers the amplified VHF signals ASS to the interface module IFM, which delivers them to the micro coaxial cable CC through its second resistor R2 and its first capacitor C3.

In a third working mode, the planar antenna device AD only delivers UHF signals.

In this case the command signal CS must be set low (for example <+1 V). Then the second transistor T2 of the switching module SM is on while the third transistor T3 of the switching module SM is off. So, the transistor T5 of the second amplifier A2 is powered on and the diode D1 of the intermediate module ITM is off. The loop antenna LA is therefore connected to the transistor T5 of the second amplifier A2 through the second coupling means CM2 and the first capacitor C12 of the second amplifier A2. The grounding of the central point of the loop antenna LA is disconnected (D1 off), diode D3 of the second amplifier A2 is also switched on, and the emitter of transistor T5 is connected to the first ground plane GP1 (through GP2), so that transistor T5 is connected both to the first ground plane GP1 (by means of its emitter) and to the loop antenna LA (by means of its base), the latter acting as a kind of monopole antenna. The cooperation of the loop antenna LA and the first ground plane GP1 through transistor T5 causes the first amplifier A1 to deliver the amplified UHF signals ASS to the interface module IFM, which delivers them to the micro coaxial cable CC through its second resistor R2 and its first capacitor C3.

Figure 6:
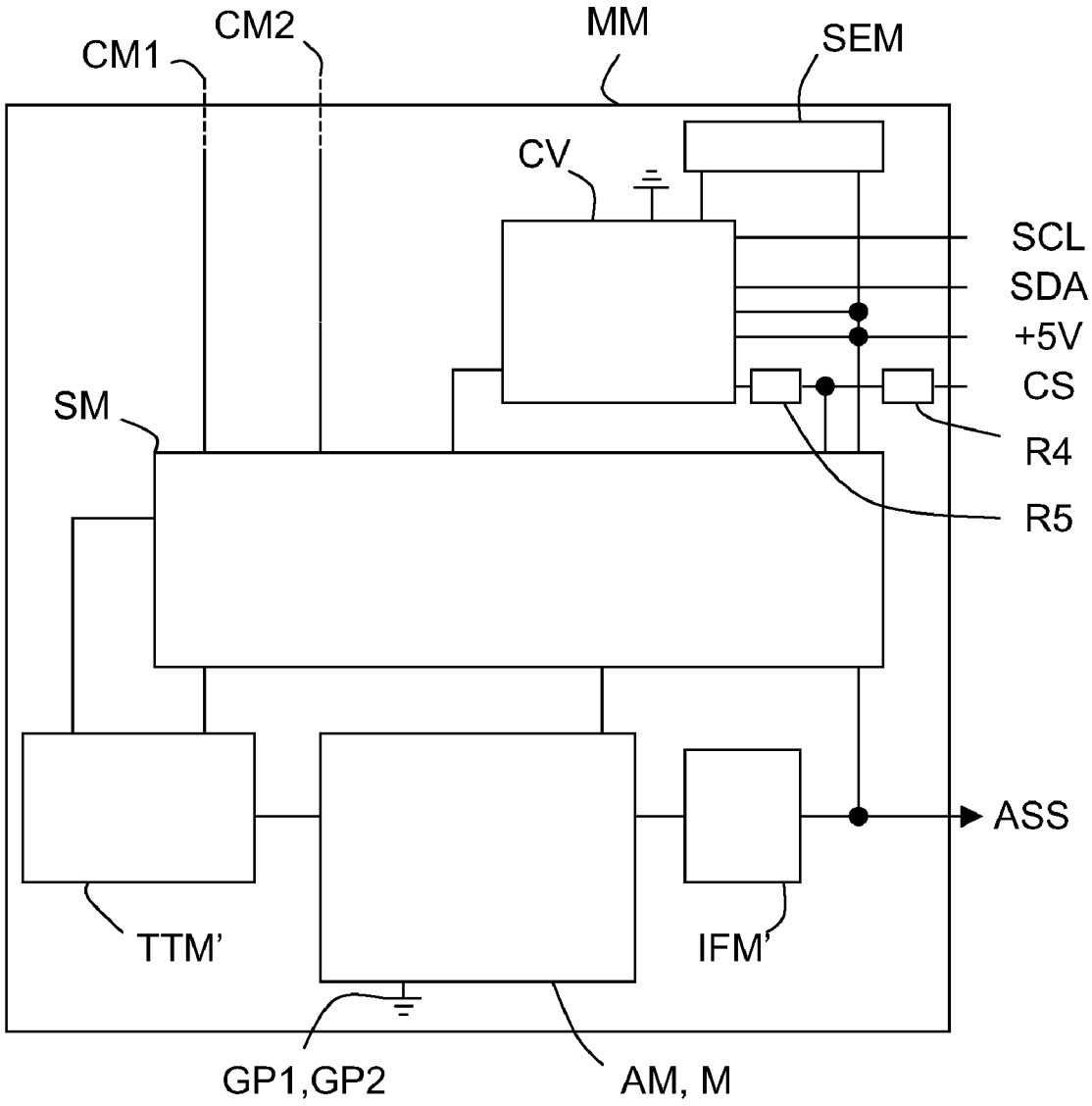
Figure 7:
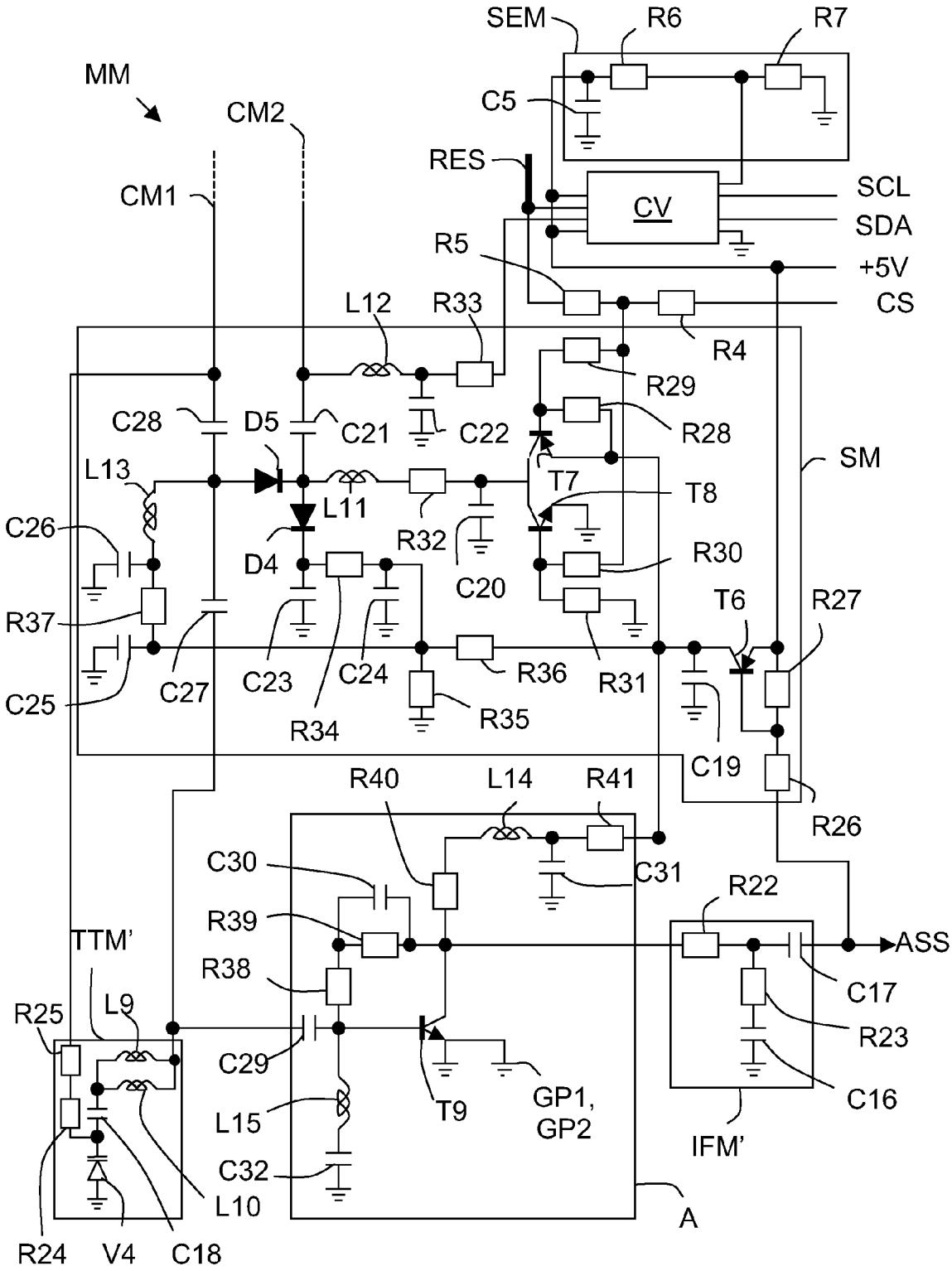

In its second embodiment, illustrated in FIGS. 6 and 7, the main module MM comprises an amplification module AM with one common amplifier A, preferably of the low-noise type and dedicated both to the VHF and UHF signal amplification.

More precisely, the amplifier A is coupled to the (first) output of the first coupling means CM1 and to the (second) output of the second coupling means CM2 through the switching module SM, and to the first ground plane GP1 through the second ground plane GP2 and the direct wiring connection, so as to amplify the TV signals having VHF and/or UHF frequencies.

The amplifier A comprises an output which is connected to an interface module IFM' whose output delivers the amplified selected signals ASS that feed the micro coaxial cable CC.

As illustrated in FIG. 7, the interface module IFM' may comprise, for example: i) a first resistor R22 connected to the output of the amplifier A and to a first node, ii) a second resistor R23 comprising a first terminal connected to the first node and a second terminal, iii) a first capacitor C16 connected to the second terminal of the second resistor R23 and to ground (GP2), and iv) a second capacitor C17 connected to the first node and to a second node defining an output for delivering the amplified selected signals ASS.

The main module MM also comprises a digital to analog converter CV which is similar or identical to the converter CV described above with reference to FIGS. 4 and 5. So, it will not be described again.

The signal input of the amplifier A may be coupled to a tunable trap module TTM' (or GSM filter) provided to filter the signals in the upper UHF range when it receives a dedicated command signal (VOUTB). As illustrated in FIG. 7, the tunable trap module TTM' may comprise, for example: i) two inductors L9 and L10 mounted in parallel between a first node, coupled to the amplifier signal input and to the switching module SM, and a second node, ii) a capacitor C18 connected to the second node and to a third node, iii) a varicap diode V4 connected to the third node and to ground (GP2), iv) a first resistor R24 comprising a first terminal connected to the third node and a second terminal, and v) a second resistor R25 comprising a first terminal connected to the second terminal of the first resistor R24 and a second terminal coupled to the second coupling means CM2 and indirectly to an analog output of the converter CV, which delivers the dedicated command signal (VOUTB) which is the tuning voltage for the varicap diode V4.

As illustrated in FIG. 7, the switching module SM may comprise, for example:

- a first resistor R26 comprising a first terminal connected to the output of the interface module IFM' and a second terminal connected to a first node,
- a second resistor R27 comprising a first terminal connected to the first node and a second terminal connected to a second node, the latter being connected to the +5 V line,
- a first transistor T6 comprising a base connected to the first node, an emitter connected to the second node, and a collector connected to a third node,
- a first capacitor C19 connected to the third node and to ground (GP2),
- a second transistor T7 comprising a base connected to a fourth node, a collector connected to a fifth node, and an emitter connected to the third node,
- a third resistor R28 comprising a first terminal connected to the third node and a second terminal connected to the fourth node,
- a fourth resistor R29 comprising a first terminal connected to the fourth node and a second terminal connected to a sixth node, the latter being connected to the node located between resistors R4 and R5 of the CS line,
- a third transistor T8 comprising a base connected to a seventh node, a collector connected to the fifth node, and an emitter connected to ground (GP2),
- a fifth resistor R30 comprising a first terminal connected to the seventh node and a second terminal connected to the sixth node,
- a sixth resistor R31 comprising a first terminal connected to the seventh node and a second terminal connected to ground (GP2),
- a second capacitor C20 connected to the fifth node and to ground (GP2),
- a seventh resistor R32 comprising a first terminal connected to the fifth node and a second terminal,
- a first inductor L11 comprising a first terminal connected to the second terminal of the seventh resistor R32 and a second terminal connected to an eighth node,
- a third capacitor C21 connected to the eighth node and to a ninth node, the latter being connected to the central point of the loop antenna LA through the second coupling means CM2,
- a second inductor L12 connected to the ninth node and to a tenth node, a fourth capacitor C22 connected to the tenth node and to ground (GP2), an eighth resistor R33 comprising a first terminal connected to the tenth node and a second terminal connected to an analog output (VOUTB) of the converter CV, which delivers the dedicated command signal (VOUTB) of the tunable trap module TTM', a first diode D4 connected to the eighth node and to an eleventh node, a fifth capacitor C23 connected to the eleventh node and to ground (GP2), a ninth resistor R34 comprising a first terminal connected to the eleventh node and a second terminal connected to a twelfth node, a sixth capacitor C24 connected to the twelfth node and to ground (GP2), a tenth resistor R35 connected to the twelfth node and to ground (GP2), an eleventh resistor R36 connected to the twelfth node and to the third node, a seventh capacitor C25 connected to the twelfth node and to ground (GP2), a twelfth resistor R37 comprising a first terminal connected to the twelfth node and a second terminal connected to a thirteenth node, an eighth capacitor C26 connected to the thirteenth node and to ground (GP2), a third inductor L13 connected to the thirteenth node and to a fourteenth node, a second diode D5 connected to the fourteenth node and to the eighth node, a ninth capacitor C27 comprising a first terminal connected to the fourteenth node and a second terminal connected both to the signal input of the amplifier A and to the first node of the tunable trap module TTM', a tenth capacitor C28 connected to the fourteenth node, and both to the (first) output of the first coupling means CM1 and to the second resistor R25 of the tunable trap module TTM'.

As illustrated in FIG. 7, the amplifier A may comprise, for example:

a first capacitor C29 comprising a first terminal connected both to the first node of the tunable trap module TTM' and to the second terminal of the ninth capacitor C27 of the switching module SM, and a second terminal connected to a first node, a transistor T9 comprising a base connected to the first node, an emitter connected to ground (GP2 and then GP1), and a collector connected to a second node defining the amplifier output connected to the signal input (R22) of the interface module IFM', a first resistor R38 comprising a first terminal connected to the first node and a second terminal connected to a third node, a second resistor R39 comprising a first terminal connected to the third node and a second terminal connected to the second node, a second capacitor C30 mounted in parallel between the second and third nodes, a third resistor R40 comprising a first terminal connected to the second node and a second terminal, an inductance L14 comprising a first terminal connected to the second terminal of the third resistor R40 and a second terminal connected to a fourth node to which is connected the switching module SM, a third capacitor C31 connected to the fourth node and to ground (GP2), and a fourth resistor R41 comprising a first terminal connected to the fourth node and a second terminal connected to the third node of the switching module SM.

The amplifier A may also comprise an inductance L15 comprising a first terminal connected to its first node and a second terminal connected to a DC blocking capacitor C32 connected to ground and acting as a shortcut for 150 MHz. The inductance L15 and the first capacitor C29 define a high pass filter. Capacitors C29 and inductance L15 can be chosen to cut off the signals lower than 150 MHz.

The planar antenna device AD again offers three working modes with the configuration described above.

In a first working mode, the planar antenna device AD delivers both UHF and VHF signals.

In this case, the connector at the end of the micro coaxial cable CC must see a DC termination in the NIM. This is the case when the NIM is connected to the planar antenna device AD (inductance L1 connected to ground (GP2) at its input). This causes the first transistor T6 of the switching module SM to power the third T7 and fourth T8 transistors of the switching module SM, which are the switches to the amplifier A. So, the amplifier A can amplify the VHF and UHF signals received by the loop antenna LA and feed the interface module IFM' with amplified VHF and UHF signals ASS.

When a connector of an additional external antenna is plugged in (by means of the RF connector switching means SW), the first resistor R11 of the switching module SM is floating. This turns the first transistor T6 of the switching module SM off, and the amplifier A is switched off. The external signal, provided by the additional external antenna, is then directly connected to the NIM.

If the additional external antenna requires a supply voltage, this may be switched on and off on the portable equipment side, either by the user (via an item on a menu) or by an autonomous switching circuit. If the user activates the +5 V supply while no additional external antenna is plugged in (RF connector switching means SW), then the planar antenna device AD is switched off.

In a second working mode, the planar antenna device AD only delivers VHF signals.

In this case the command signal CS must be set low (for example <+1 V). Then the second transistor T7 and the first diode D4 of the switching module SM are on, while the third transistor T8 and the second diode D5 of the switching module SM are off. The transistor T9 of the amplifier A is always powered if no additional external antenna is used. The first diode D4 being on and connected to the second coupling means CM2 through the third capacitor C21, it RF-grounds the central point of the loop antenna LA through the fifth capacitor C23 of the switching module SM. So, the transistor T9 of the amplifier A is fed with the tapped VHF signals delivered by the first coupling means CM1 through the tenth C28 and ninth C27 capacitors of the switching module SM and the first capacitor C29 of the amplifier A. The amplifier A delivers the amplified VHF signals ASS at its output connected to the interface module IFM', and the interface module IFM' delivers these signals ASS to the micro coaxial cable CC through its first resistor R22 and its second capacitor C17.

In a third working mode, the planar antenna device AD only delivers UHF signals.

In this case the command signal CS must be set high (for example >+4 V). Then the second transistor T7 and the first diode D4 of the switching module SM are off, while the third transistor T8 and the second diode D5 of the switching module SM are on. The first diode D4 being off and the second diode D5 being on, the transistor T9 of the amplifier A is coupled to the loop antenna LA through the second coupling means CM2, the third capacitor C21, the second diode D5, the ninth capacitor C27 of the switching module SM, and the first capacitor C29 of the amplifier A. The grounding of the central point of the loop antenna LA being disconnected (D4 off), diode D5 being switched on, and the emitter of transistor T9 being connected to the first ground plane GP1 (through GP2), the transistor T9 is now connected both to the first ground plane GP1 and to the loop antenna LA, which acts as a kind of monopole antenna. The cooperation of the loop antenna LA and the first ground plane GP1 through transistor T9 enables the amplifier A to deliver the amplified UHF signals ASS at its output connected to the interface module IFM', and the interface module IFM' can deliver these signals ASS to the micro coaxial cable CC through its first resistor R22 and its second capacitor C17.

The invention is not limited to the embodiments of planar antenna devices (AD) and electronic equipment (PE) described above merely by way of example, but it encompasses all alternative embodiments which may be considered by those skilled in the art within the scope of the claims hereafter.

In the present specification and claims the word "a" or "an" preceding an element does not exclude the presence of a plurality of such elements. Further, the word "comprising" does not exclude the presence of other elements or steps than those listed.

The inclusion of reference signs in parentheses in the claims is intended to aid understanding and is not intended to be limiting.

The invention claimed is:

1. Planar antenna device for an electronic device characterized in that it comprises:

i) a loop antenna with a chosen shape and comprising first and second ends spaced one from the other, ii) a tuning means connected to said first and second ends and arranged to control the frequency of the VHF TV signals said loop antenna is able to receive from command signals, iii) a first ground plane coupled so as to cooperate with the loop antenna in order that it acts as a UHF monopole for receiving TV signals having UHF frequencies, iv) a first coupling means coupled to the loop antenna at a first chosen location and arranged to deliver the received TV signals having VHF frequencies, v) a second coupling means coupled to the loop antenna at a second chosen location and arranged to deliver the received TV signals having UHF frequencies, vi) an amplification means coupled to the first ground plane and arranged to amplify TV signals, and vii) a switching means arranged to couple the amplification means to the first coupling means and/or to the second coupling means in dependence on command signals, such that the amplification means delivers amplified selected TV signals having VHF and/or UHF frequencies to an output.

2. Planar antenna device according to claim 1, characterized in that said amplification means and switching means are located outside the loop antenna, in that the switching means comprises first and second inputs connected to the first and second coupling means, respectively, and an output connected to an input of the amplification means and connectable either to the first input or to the second input in dependence on command signals, in that the first coupling means comprises a coupling loop having first and second ends connected to the first input of the switching means and to the first ground plane, respectively, and in that the second coupling means is a coupling track defining a UHF monopole connecting the loop antenna (LA) to the second input of the switching means.

3. Planar antenna device according to claim 2, characterized in that the loop antenna has approximately a square shape.

4. Planar antenna device according to claim 2, characterized in that the coupling loop is of a single-ended type with a far end connected to the first ground plane.

5. Planar antenna device according to claim 2, characterized in that the coupling loop is of a differential type with a coupling to the amplification means via a balun.

6. Planar antenna device according to claim 2, characterized in that the coupling loop has approximately a rectangular shape.

7. Planar antenna device according to claim 1, characterized in that the amplification means and switching means are located in a chosen part of an area which is defined by the loop antenna and which comprises a second ground plane defining ground for the amplification means and connected to the first ground plane through a direct wiring connection, in that the first coupling means comprises at least one coupling track connected to the loop antenna at the first chosen location and coupled to the amplification means, and in that the second coupling means is connected to the loop antenna at the second chosen location and to the switching means.

8. Planar antenna device according to claim 7, characterized in that the amplification means comprises a first amplifier coupled to the first coupling means and to the second ground plane to amplify the selected received TV signals having VHF frequencies, and a second amplifier coupled to the loop antenna through the second coupling means and to the second ground plane to amplify the selected received TV signals having UHF frequencies.

9. Planar antenna device according to claim 7, characterized in that the amplification means comprises a common amplifier coupled to the first coupling means, to the loop antenna through the second coupling means, and to the second ground plane to amplify the selected received TV signals having VHF frequencies and/or UHF frequencies.

10. Planar antenna device according to claim 7, characterized in that the loop antenna has approximately a rectangular shape.

11. Planar antenna device according to claim 1, characterized in that the tuning means comprises two identical varactors mounted in series and having first terminals connected to the first and second ends of said loop antenna, respectively, and second terminals DC grounded through first and second decoupling inductance means.

12. Planar antenna device according to claim 1, characterized in that it comprises a digital to analog converter arranged to convert some digital command signals into analog command signals, and/or at least one command line to provide some other command signals.

13. Planar antenna device according to claim 1, characterized in that at least the loop antenna, tuning means, first coupling means, amplification means, and switching means are defined on a printed circuit board.

14. Electronic device, characterized in that it comprises a planar antenna device according to claim 1 and a TV receiver connected to said planar antenna device.

15. Electronic device according to claim 14, characterized in that it is chosen from a group comprising at least a mobile phone, a cordless phone, a personal digital assistant, a portable television, a personal computer, and a laptop.

* * * * *